US006914597B2

(12) United States Patent
Myers

(10) Patent No.: US 6,914,597 B2
(45) Date of Patent: Jul. 5, 2005

(54) SYSTEM FOR BI-DIRECTIONAL VIDEO SIGNAL TRANSMISSION

(75) Inventor: Robert L. Myers, Loveland, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 658 days.

(21) Appl. No.: 09/978,279

(22) Filed: Oct. 17, 2001

(65) Prior Publication Data

US 2003/0071799 A1 Apr. 17, 2003

(51) Int. Cl.[7] ..... G09G 5/00
(52) U.S. Cl. ..... 345/204; 326/36; 326/86
(58) Field of Search ..... 345/204; 326/30, 326/95, 86, 87, 90; 327/52, 55, 57

(56) References Cited

U.S. PATENT DOCUMENTS 5,553,064 A * 9/1996 Paff et al. ..... 370/478
5,781,028 A * 7/1998 Decuir ..... 326/30
5,974,199 A * 10/1999 Lee et al. ..... 382/289
6,366,130 B1 * 4/2002 Podlesny et al. ..... 326/95
6,564,269 B1 * 5/2003 Martin ..... 710/20

* cited by examiner

*Primary Examiner*—Guy J. Lamarre
*Assistant Examiner*—Fritz Alphonse

(57) ABSTRACT

A bi-directional high speed video data transmission system. A transmitter transmits an encoded video data stream across a data pair to a receiver by switching a DC current, via a pair of transistors, across the two data lines comprising the data pair. As the current varies on the data lines, so too does the voltage. The receiver decodes the serial video data stream back into its component parts so that the video data may be displayed by an appropriate display device. A pair of summing resistors adds the AC currents seen across the data lines to reconstruct the original DC current as a DC return current. The DC return current may be used to drive a return transmitter located on the original receiving side in order to send video data to the original transmitting side of the bi-directional video data transmission system.

19 Claims, 9 Drawing Sheets

SYSTEM FOR BI-DIRECTIONAL VIDEO SIGNAL TRANSMISSION

TECHNICAL FIELD

The technical field is generally video transmission, and more specifically a high-speed digital interface for bi-directionally transmitting video information.

BACKGROUND

As computers have increased in speed and complexity, so too has the video data transmitted from a processor, motherboard, or graphics card to a video display. Along with this increased complexity comes an increase in the raw amount of video data transmitted. For example, early video displays comprised simple ASCII text, which eventually gave way to monochromatic graphics. This evolution continued through the Color Graphics Adapter (CGA) video standard, the Video Graphics Array (VGA) video format, and so forth to today's high-resolution video display formats. Each step up in video display quality required a concurrent step in the speed with which video data was transmitted, and the development of new video circuitry to meet increasing transmission requirements.

Today, the transition-minimized differential signaling (TMDS) interface is used as a basis for several video display standards, including the VESA Digital Visual Interface (DFP) and "Plug & Display" (P&D) standards, as well as the Digital Visual Interface (DVI) specification from the Digital Display Working Group. The TMDS interface is generally embodied as a microcircuit capable of high speed serial video transmission in a single direction. A TMDS circuit accepts three parallel video data inputs, encodes the video data via a proprietary algorithm, and transmits encoded data as a serial transmission. Further, the TMDS interface is used by many digital video sources, such as digital still cameras, televisions, and video cameras.

However, modern video transmission systems are typically configured as unidirectional transmitters. That is, each system transmits data, but is unable to receive data without the addition of a second specially configured transmission system. For example, the TMDS interface described above requires that each data transmission source have a completely separate TMDS-compatible receiver in order to receive return video data. This adds to the overall design complexity and manufacturing cost when developing video systems based on the TMDS standard. In applications where many simultaneous video transmissions are required, such as a videoconference or multi-camera video shoot, the cost of these extra transmitters and receivers becomes prohibitive.

Accordingly, there is a need for an improved video data transmission system.

SUMMARY

Generally speaking, the present invention comprises a bi-directional high speed video data transmission system. A transmitter receives a parallel video data stream, a clock signal, and a control signal. The control signal and parallel video data stream are encoded as a serial video data stream and transmitted across a data pair to a receiver, along with the clock signal. This transmission is accomplished by using a pair of transistors to switch a DC current across the two data lines comprising the data pair. This switching creates an AC current on each data line. Further, as the current varies on the data lines so too does the voltage. Thus, the serial video data stream may be transmitted as short bursts of voltage differential measured across a pair of terminating resistors located within the receiver. The clock signal indicates when current is switched from one line to another.

The receiver decodes the serial video data stream back into its component parts so that the video data may be displayed by an appropriate display device. Further, one summing resistor is connected to each of the first and second data lines. This pair of summing resistors adds the AC currents seen across the data lines to reconstruct the original, switched DC current as a DC return current. In order to close the current loop between the transmitter and receiver, a return current path from receiver to transmitter must be provided.

This return current path provides an opportunity to transmit information from the receiving device to the transmitting device. Accordingly, the DC return current may be used to drive a transmitter located on the original receiving side in order to send video data to the original transmitting side of the bi-directional video data transmission system. The DC return current may be passed to a return transmitter electrically connected to the receiver. This return transmitter operates in a manner similar to the transmitter described above, using a pair of transistors to switch the DC return current across two dedicated return data lines leading to a return receiver located within the device housing (and also electrically coupled to) the original transmitter. Again, the return transmitter may encode a video data stream for transmission across the return data lines. As the DC return current is switched across these lines, the return receiver detects the encoded video data as a resulting voltage differential. A second pair of summing resistors is likewise connected to the return data lines and the original transmitter. This second pair of summing resistors adds the AC currents generated in the return data lines together into a DC current, which is in turn passed to the original transmitter. This completes the necessary current loop.

The bi-directional high speed video communications system may also be provided with one or more filters to screen out transients generated when current is switched from one data line to another. Further, the current switching in both directions may be controlled by a single clock signal, or a clock signal dedicated to each transmission direction may be used.

That the present invention fulfills the need for an improved video data transmission system will be apparent to those of ordinary skill in the art upon reading the following description and appended claims.

DESCRIPTION OF THE DRAWINGS

The detailed description will refer to the following drawings, wherein like numerals refer to like elements, and wherein.

DETAILED DESCRIPTION

Figure 1:
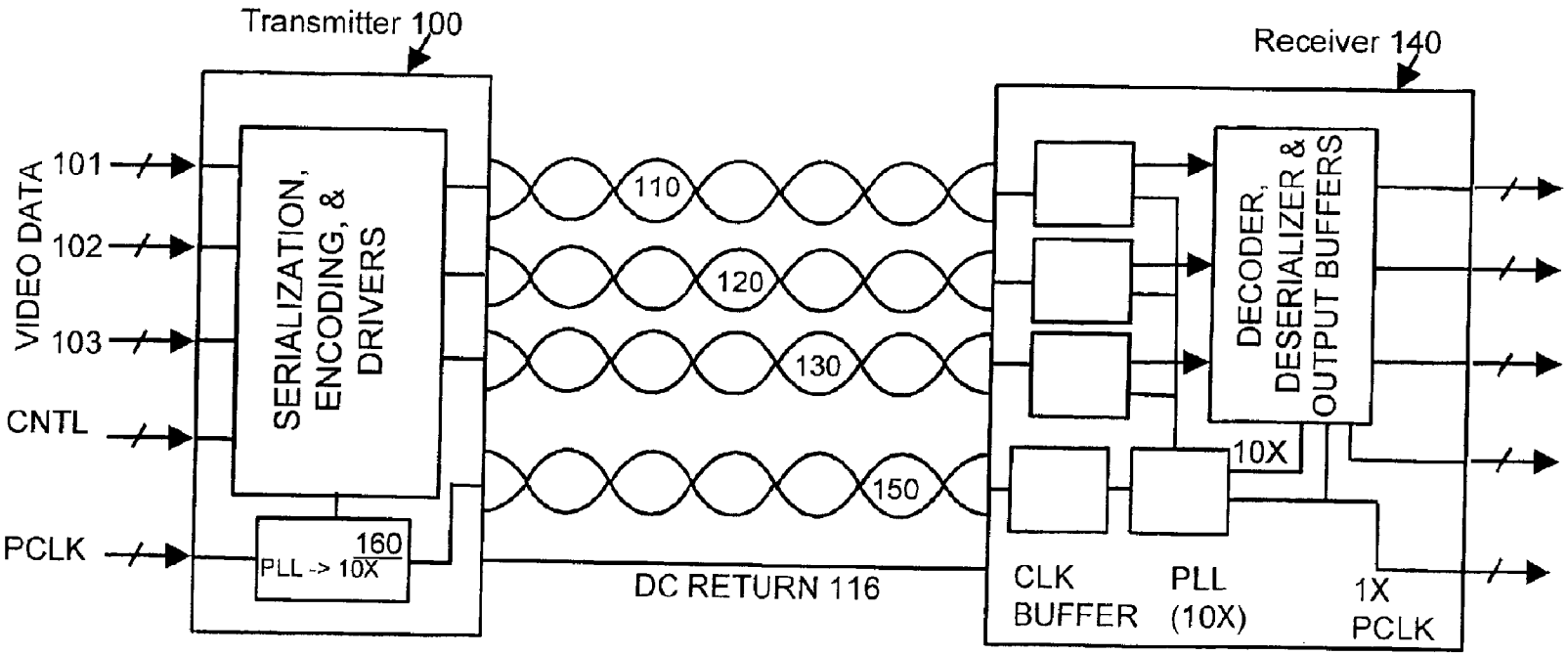
FIG. 1 displays a block diagram of a conventional transition-minimized differential signaling (TMDS) system.

Generally speaking, a transition-minimized differential signaling (TMDS) circuit, as shown in FIG. 1, is used to transmit digital video data at relatively high rates of speed. The TMDS circuit converts parallel video data streams, video display timing information, and control signals to a plurality of serial data signals, which are transmitted from a transmitter 100 across data pairs 110, 120, 130 to a receiver 140. A DC return channel 116 is provided to close the current loop between the transmitter 100 and receiver 140.

The transmitter 100 receives parallel video data streams through a series of inputs 101, 102, 103 from a video data source (not shown), such as a graphics card or chip, a video camera, or computer peripheral. Generally, each video data stream is an eight bit signal, while the control signal comprises four bits and the clock signal a single bit. Alternate embodiments, however, may use a different number of bits for each signal. The transmitter 100 creates a ten bit output by encoding each video data stream and the control signal. Effectively, the control signal is encoded with each of the video data streams. This ten bit output is then serialized. Further, the converted serial data is transmitted to the receiver as a DC-balanced signal. A clock signal, generated by a phase locked loop 160 (PLL) from a reference clock input, regulates the signal transmission timing and is transmitted across a clock data pair 50 to the receiver 140.

The receiver 140 recovers the converted serial data by oversampling each of the three serial data streams. The receiver 140 also receives the clock signal across the clock data pair 150, but does not regulate its serial data stream sampling according to the clock pulses. Rather, the oversampled data are received and converted back into ten bit character data by a deserializer contained within the receiver 140. The deserializer passes the ten bit data to a decoder, also contained within the receiver 140, which in turn converts the ten bit character data into its original eight bit form. The decoder synchronizes the eight bit data stream with the clock signal to determine exactly when each eight bit data byte begins and ends.

The foregoing is a general overview of the functionality and operation of a TMDS circuit. The TMDS circuit and its capabilities are more fully described in U.S. Pat. No. 5,974,464, issued on Oct. 26, 1999, entitled "System for High Speed Serial Video Signal Transmission Using DC-Balanced Coding," and invented by Yeshik Shin et. al.

Figure 2:
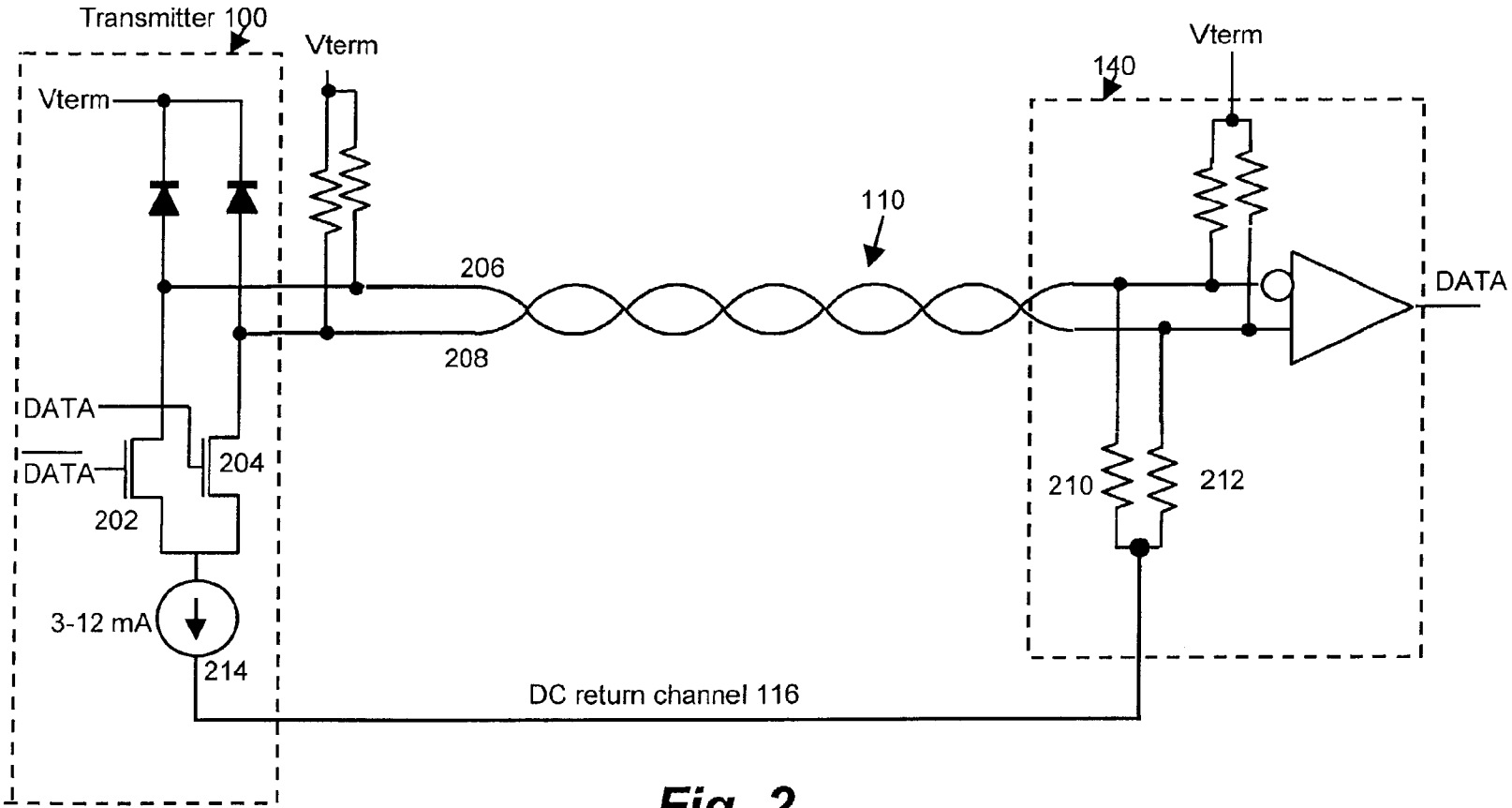
FIG. 2 displays a circuit diagram of a conventional TMDS transmitter and receiver pair.

FIG. 2 displays a partial circuit diagram of the output portion of a single TMDS transmitter 100 and the corresponding input portion of a TMDS receiver 140. It should be noted that, despite its name, a TMDS circuit does not transmit data by varying voltage but instead by pulling a DC current from the transmitter 100, across a data pair 110, and to the receiver 140. In order to accomplish this, a TMDS transmitter 100 uses two transistors 202, 204 to steer a fixed current between the two data lines 206, 208 comprising each data pair. At any given time, one line carries current and one does not. As previously mentioned, this constant switching action induces an AC current and voltage differential across each data line. When a data signal is received by a transistor 202, 204, the transistor biases to permit current to flow from the current source 214, through the transistor, and along a data line 206, 208 to the receiver 140.

As the transistors 202, 204 alternate current between each line 206, 208, the voltage of the live data line varies from a high of the reference voltage Vterm to a low of zero. Typically, Vterm is approximately 500 millivolts, although alternate embodiments may employ different reference voltages.

The receiver 140 detects the resulting voltage differentials across the summing resistors 210, 212 at the receiver end of the line. In order to accomplish this, a current return path 116 must be provided between the transmitter and receiver. Accordingly, the connections between a TMDS transmitter 100 and receiver 140 typically include a dedicated return 116 for each pair of data or clock transmission lines 206, 208, although alternate embodiment may permit one current return per two data or clock pairs. As the transmitter 100 steers the DC current from one data line 206, 208 to the other, the currents in the data pair conductors are summed through a pair of summing resistors 210, 212 into the DC return channel 116. Since the sum of the current through the data pair 110 at any given moment is a constant, the return channel 116 carries a DC current from the receiver back to the transmitter. While some noise may be introduced into the return DC current due to switching between the two data lines 206, 208, the noise is typically minimal and does not affect the operation of the TMDS circuit.

Many times, bi-directional data transmission may prove desirable. For example, in a videoconference data may flow freely back and forth between a first TMDS circuit in a computer or display device and a second such circuit in a video camera. The return current path 116 may be used as a return data path to transmit data from a TMDS circuit co-located with the receiver to a receiver co-located with the original transmitter. Essentially, each device engaged in bi-directional data transmission will contain both a TMDS transmitter and receiver, using the return channel as a data pair to transmit information from the original receiver to the original transmitter.

Figure 3:
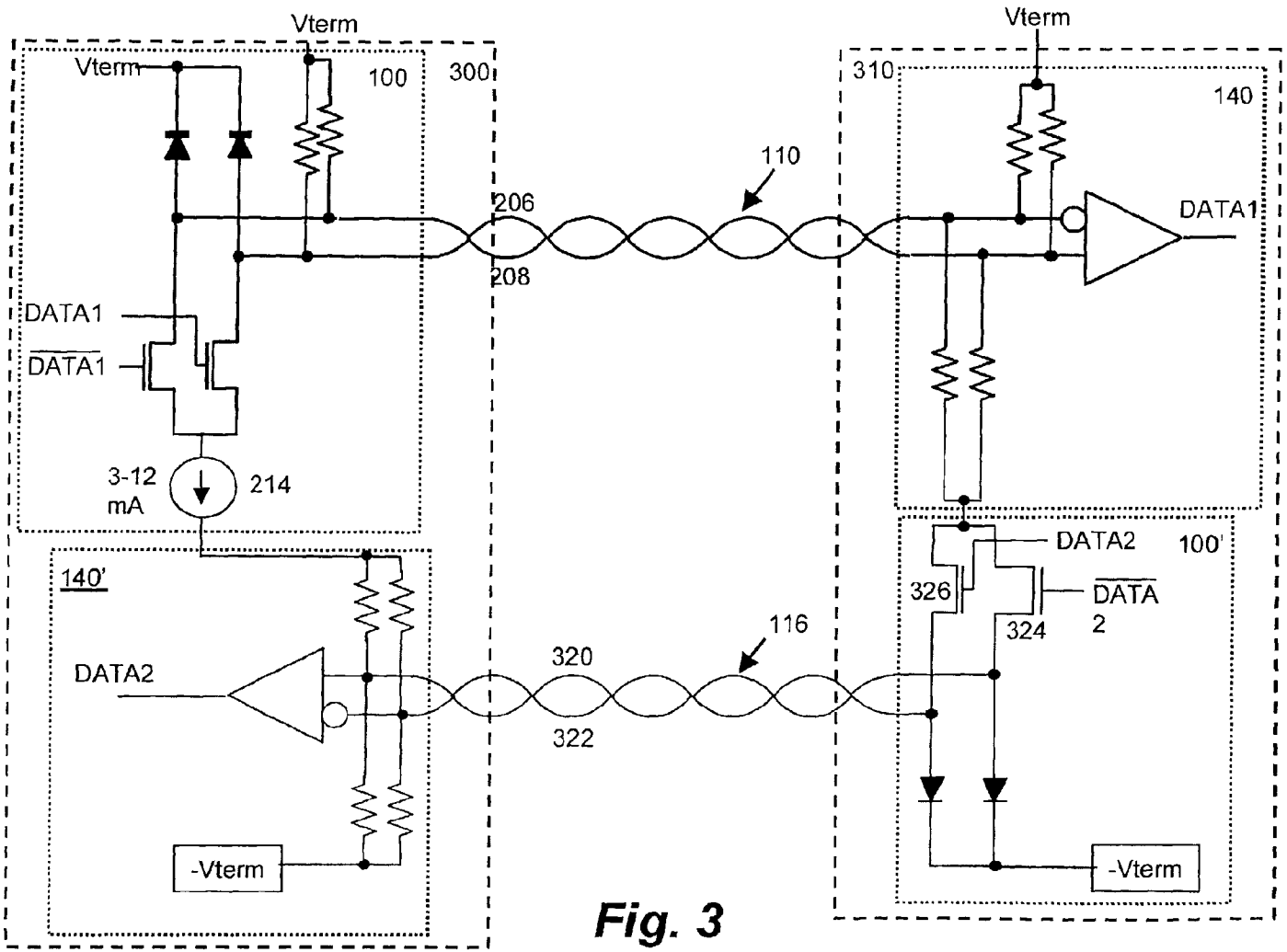
FIG. 3 displays a circuit diagram of a bi-directional communication TMDS system including a return data channel.

FIG. 3 displays an embodiment of a bi-directional TMDS system. As can be seen, each bi-directional TMDS circuit 300, 310 contains both a transmitter 100, 100' and receiver 140, 140'. This permits each bi-directional TMDS circuit to both send and receive data. Instead of using a single line as the current return channel 116, a pair of return data lines 320, 322 is employed as a return channel 116. By connecting the pair of return data lines 320, 322 to a slightly modified return transmitter 100', which is in turn electrically connected to the original receiver 140, data may be transmitted from the second bi-directional TMDS circuit 310 to the first bi-directional TMDS circuit 300. Thus, a return data channel may be added at the minimal cost of including a single extra data line.

As can be seen from FIG. 3, the receivers 140, 140' located in each of the bi-directional TMDS circuits 300, 310 are identical in construction and effect. Each receives data across a data pair by measuring the voltage differential between the lines 206, 208, 320, 322 comprising the pair. However, the transmitters 100, 100' differ in one respect: only one transmitter requires a current source 214. The second bi-directional TMDS circuit 310 simply receives the current from the data lines 206, 208, sums the current within the receiver 140' to create a DC current as previously discussed, and uses the summed DC current in the transmitter 110' in lieu of a dedicated current source 214. Thus, both of the bi-directional TMDS circuits 300, 310 are driven by a single current source 214.

The two transistors 324, 326 within the return transmitter 100' may now steer a summed current from the second bi-directional TMDS circuit 310 to the first bi-directional TMDS circuit's 300 receiver 140'. In a manner similar to that described with respect to FIG. 2, the transistors 324, 326 may thus transmit data across the return data lines 320, 322. Thus, a return channel, configured in the same manner as the data pair 110, has been created by adding one additional conductor 322 to the original return channel 116.

Figure 4:
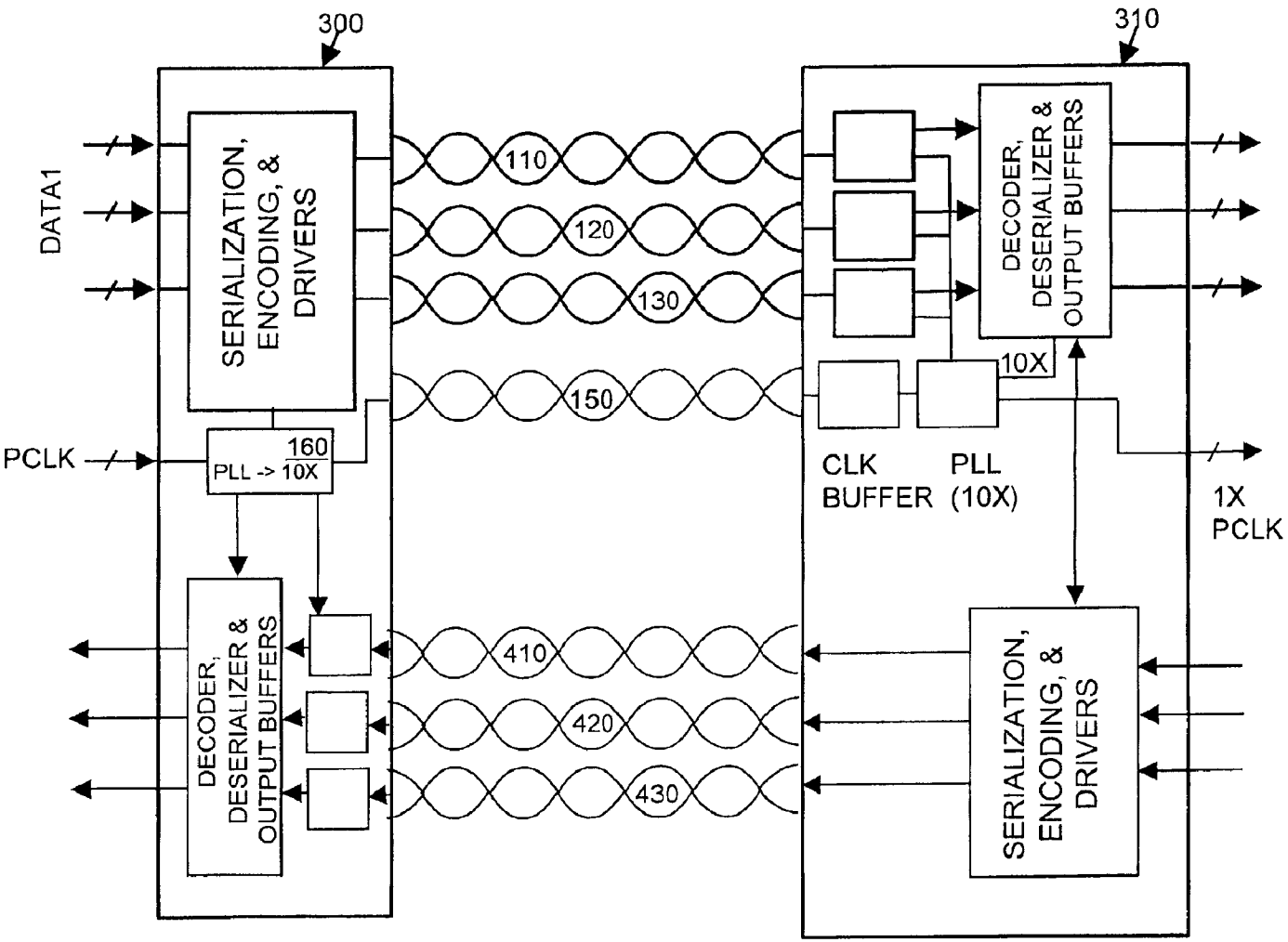
FIG. 4 displays a block diagram of a bi-directional communication TMDS system employing a single clock to time data streams traveling in both directions.

Of course, more than a single return data pair may be added. FIG. 4 displays a pair of bi-directional TMDS circuits 300, 310 having three data pairs 110, 120, 130, 410, 420, 430 transmitting data in each direction. Generally, three data pairs may be used in each direction in order to mimic the original TMDS circuit output, which accepts three separate parallel video data streams and converts them to three serial data streams. In this manner, the TMDS receiver circuit design remains unaltered.

As can be further seen in FIG. 4, a single clock signal transmitted across a clock data pair 150 may be used to time data transmission in both directions. In the embodiment shown in FIG. 4, the clock signal is generated by a PLL 160 located within the first bi-directional TMDS transmitter 300. The clock signal may be transmitted across the clock data pair 150 to the second bi-directional TMDS transmitter 310 in a manner similar to that described with respect to FIGS. 1 and 2. Employing a single PLL 160 and clock signal minimizes design and manufacturing expenses by reducing the number of necessary components.

However, not all video data transmissions operate at the same frequency, or at multiples of the same frequency. Some video data, for example, may be transmitted at 100 MHz, while another source may send video data at 133 MHz. Where two such video sources are transmitting data between each other, it may be desirable to employ a clock signal dedicated to each bi-directional TMDS transmitter 300, 310.

Figure 5:
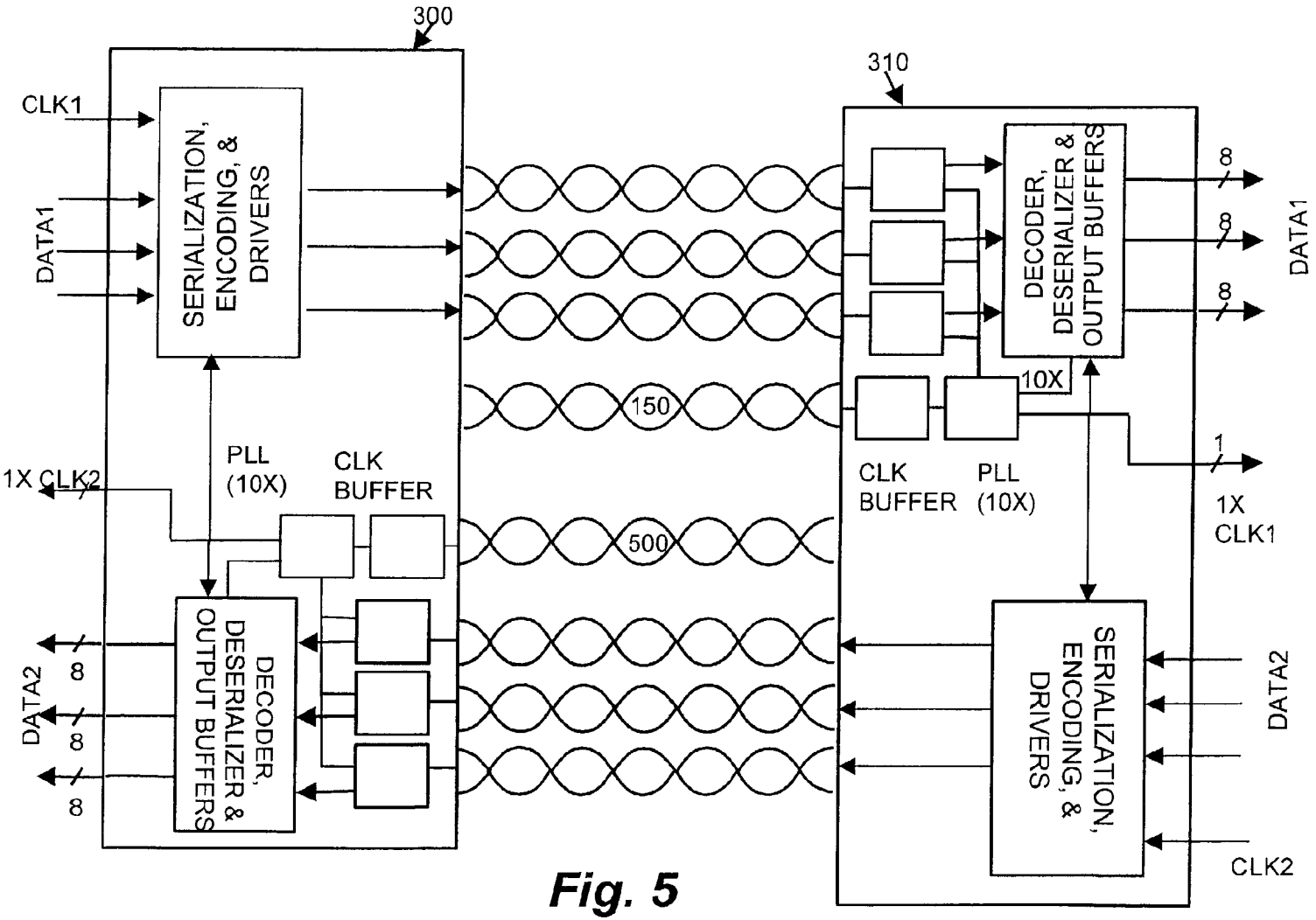
FIG. 5 displays a block diagram of a bi-directional communication TMDS system employing a dedicated clock for each transmitter.

For example, the embodiment displayed in FIG. 5 includes a first clock pair 150 for timing data received from the first bi-directional TMDS circuit 300, and a second clock pair 500 for timing data transmitted by the second bi-directional TMDS circuit 310. In this embodiment, each clock signal has a period corresponding to the transmission frequency of the video data transmitted by the bi-directional TMDS circuit 300, 310 associated with the clock signal. Continuing with the example, the first clock pair 150 may transmit a clock signal with a period of 0.00000001 seconds, while the second clock pair 500 may transmit a clock signal with a period of approximately 0.00000000752 seconds.

Returning briefly to FIG. 1, a discussion of switching noise may be useful to understand the need for a filter in a bi-directional TMDS transmitter design. As previously mentioned, a basic TMDS transmitter 100 operates by switching current between two data lines 206, 208 comprising a data pair 110. The receiver 140 receives and sums the current from both data lines 206, 208 in order to generate a DC return signal 116. However, the act of switching between the data lines 206, 208 may induce switching transients in the currents themselves. When these switching transients occur, they cause the current carried by the data pairs 110, 120, 130 to spike upward or downward. The current spikes may be included by the receiver 140 and the summing resistors 210, 212 during the summing operation. Therefore, the DC return signal 116 may include brief deviations from the base DC signal induced by the switching transients. These deviations are generally referred to as "line noise".

In a basic TMDS circuit, such line noise may typically be ignored, because the return channel carries no data. However, in the case of a bi-directional communications system, the second bi-directional TMDS transmitter 310 uses the summed DC current to drive a return data path. Line noise in the summed DC current may result in data corruption across the return data lines 320, 322.

Figure 6:
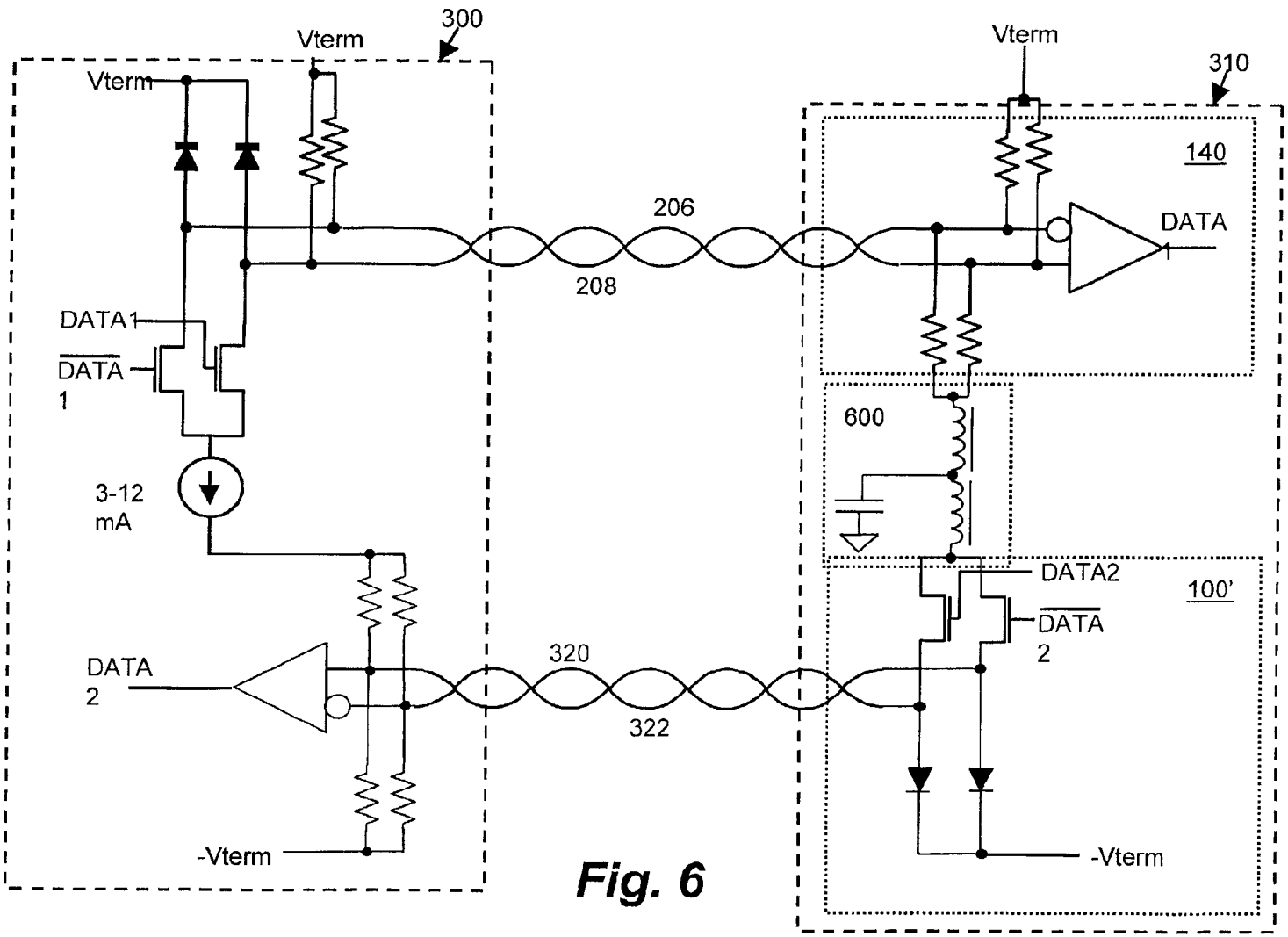
FIG. 6 displays a circuit diagram of a bi-directional communication TMDS system having a return current filter.

One embodiment of the bi-directional TMDS circuit 310, as shown in FIG. 6, employs a filter 600 to eliminate line noise and thus preserve data integrity. The filter 600 is generally placed between the receiver 140 and return transmitter 100' portions of the bi-directional TMDS circuit 310, in order to squelch line noise after current summing is completed. Although FIG. 6 displays a typical LC filter 600, it should be understood that many different types of filters could be employed instead. For example, an active RC filter employing a passive network or operational amplifier may be used in place of the LC filter. Other filters will be apparent to those skilled in the art.

Figure 7:
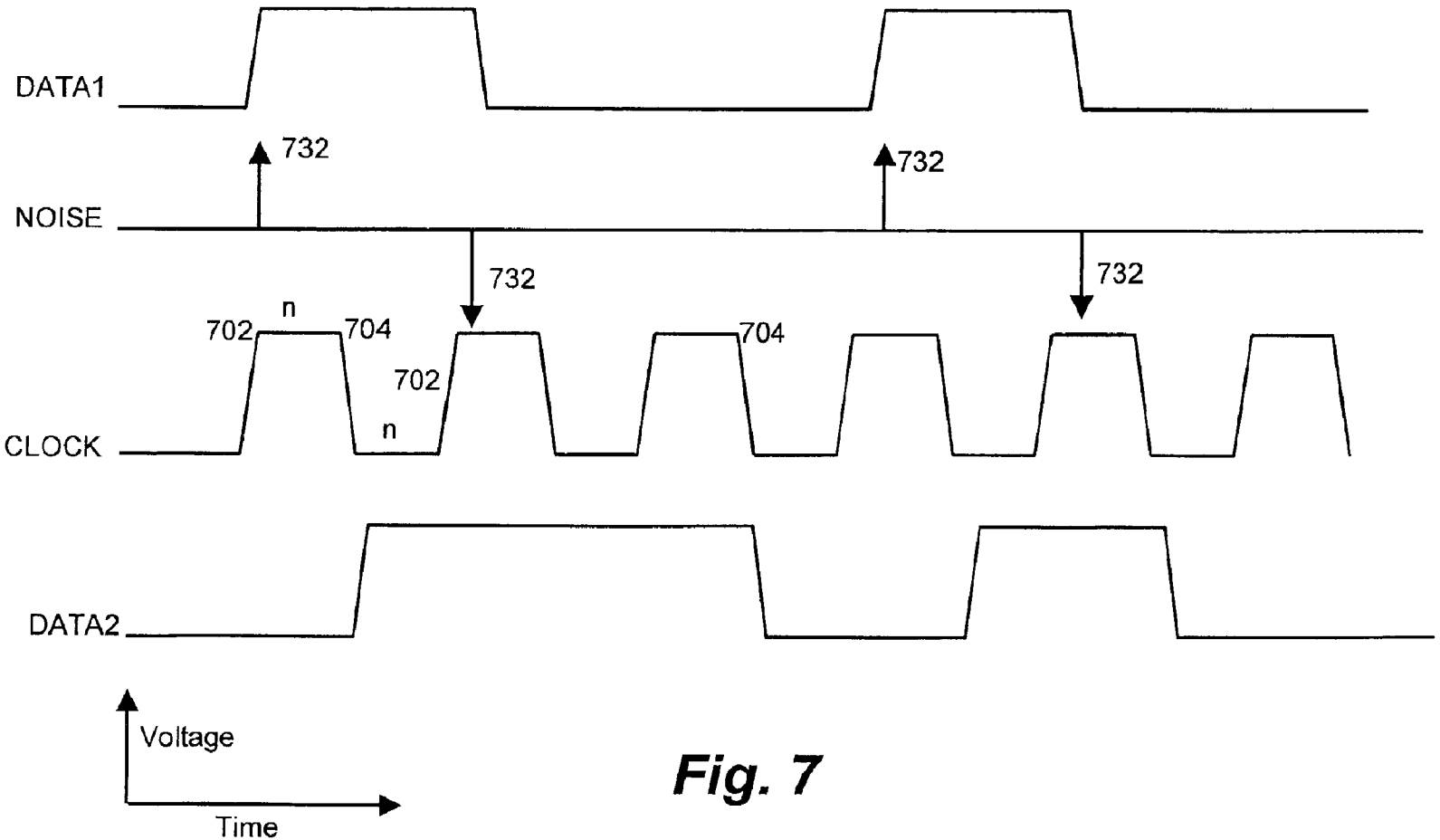
FIG. 7 displays a time graph of clock and data signals including noise resulting from line interference.

FIG. 7 displays a switching diagram for a clock signal, DATA1, and DATA2. For reference, the height of each signal represents voltage and the length is measured in time. Further, the clock signal routinely switches every n milliseconds from a zero voltage to voltage Vref, and back again at the end of the same time interval. It should also be noted that the switching diagram of FIG. 7 presumes that a single clock signal times all transmissions between a first and second bi-directional TMDS circuit 300, 310.

DATA1 represents the video data transmitted by the first bi-directional TMDS circuit 300, while DATA2 is the signal transmitted by the second bi-directional TMDS circuit 310. As can be seen, the rising edge 702 of the clock signal triggers the beginning of a data transmission in DATA1. The DATA1 data transmission similarly ends when the next rising edge 702 of the clock signal is reached. In this manner, DATA1 may be said to "clock on the rising edge" of the clock signal. Similarly, DATA2 clocks on the falling edge 704 of the clock signal.

As previously mentioned, noise is injected into a data line when the current (and concurrent voltage) is switched on that line. Accordingly, line noise 732 is injected into the summed DC current outputted by the receiver only when DATA1 switches states. That is, DATA1 generates noise only during the rising edge of the clock signal, and this noise therefore only passes to the DC return current at the same time. The NOISE signal shows the time at which line noise 732 is injected into the system.

Since DATA2 uses the summed DC return current to transmit data, line noise 732 will appear in DATA2 only when the clock signal rises. By clocking DATA2 off the falling edge of the clock signal, line noise injected by DATA1's state switch occurs only during a steady state in DATA2. Since the line noise 732 occurs out of phase with the latching of data, it may safely be disregarded by the receiver 140. It should be noted that this procedure also limits line noise induced in DATA1 by the DATA2's switching, for the same reasons given above.

From a manufacturing standpoint, it may be desirable to standardize a bi-directional TMDS transmitter in order to minimize manufacturing costs. Further, a standardized design would permit any bi-directional TMDS transmitter to interface with another, without requiring, for example, one bi-directional transmitter to include a current source and the other a filter.

Figure 8:
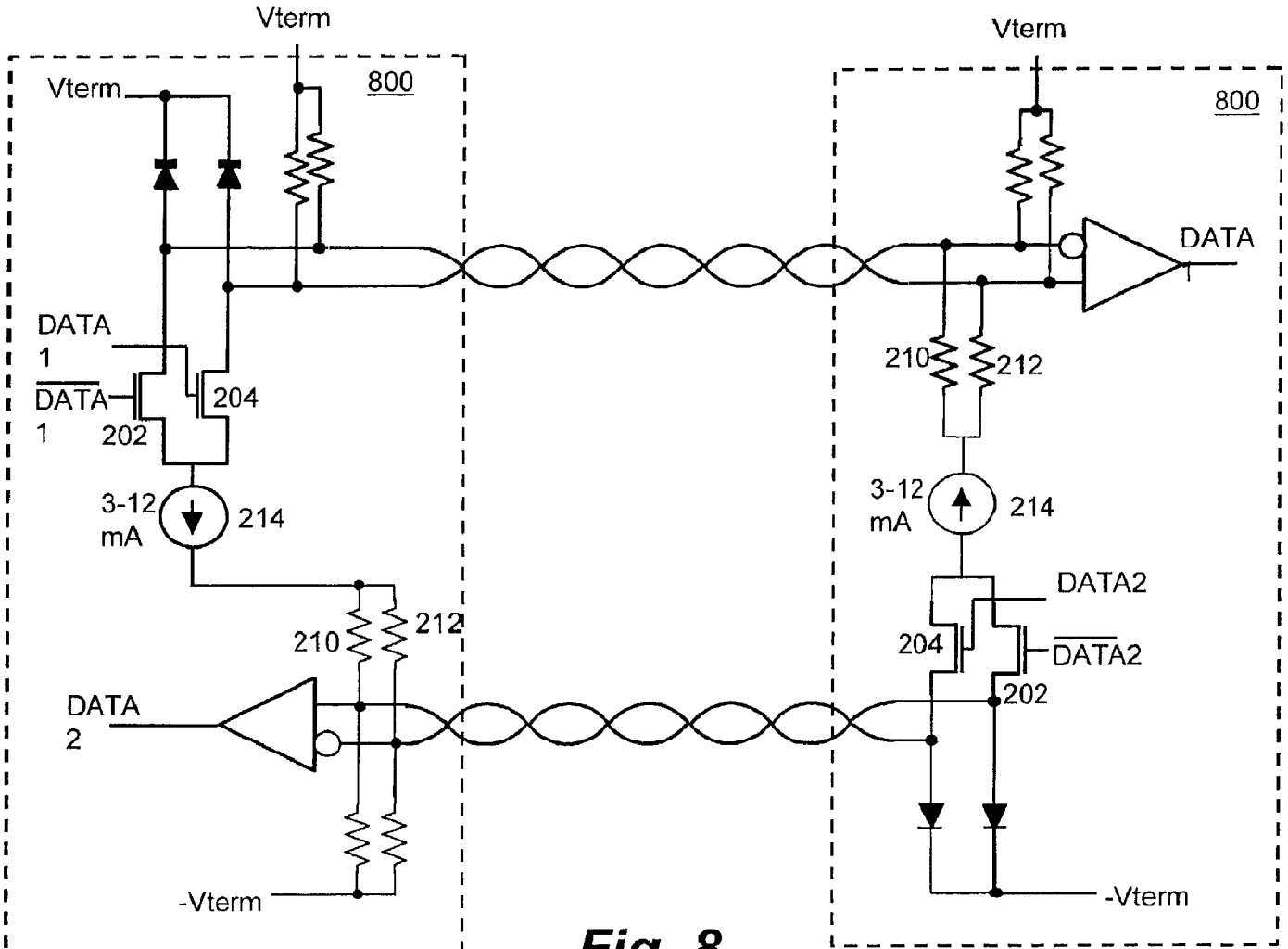
FIG. 8 displays a bi-directional TMDS transceiver.

FIG. 8 displays a standardized bi-directional TMDS transceiver 800. Each transceiver 800 is capable of both sending and receiving video data. The transceiver contains a pair of transistors 202, 204 that drive current across a data pair, a current source 214, and summing resistors 210, 212 to return a DC current to the transmitter portion of the transceiver. Although not shown, the transceiver 800 may also include a filter to eliminate noise. The standardized transceiver 800 effectively integrates a transmitter 100 and receiver 140 into a single package, without requiring each end of a bi-directional TMDS system to have a unique circuit design.

Of course, the transceiver's 800 data transmission and reception may suffer from line noise induced by switching transients, as previously described with respect to FIGS. 6 and 7. Accordingly, alternate embodiments of the transceiver 800 may include a filter 600 as previously described, or may transmit and receive data via out of phase data signals, as described with respect to FIG. 7. Further, multiple transceivers 800 in communication with one another may employ a single clock to control the timing of data transmissions, may each use a dedicated clock, or may have some combination thereof.

Figure 9:
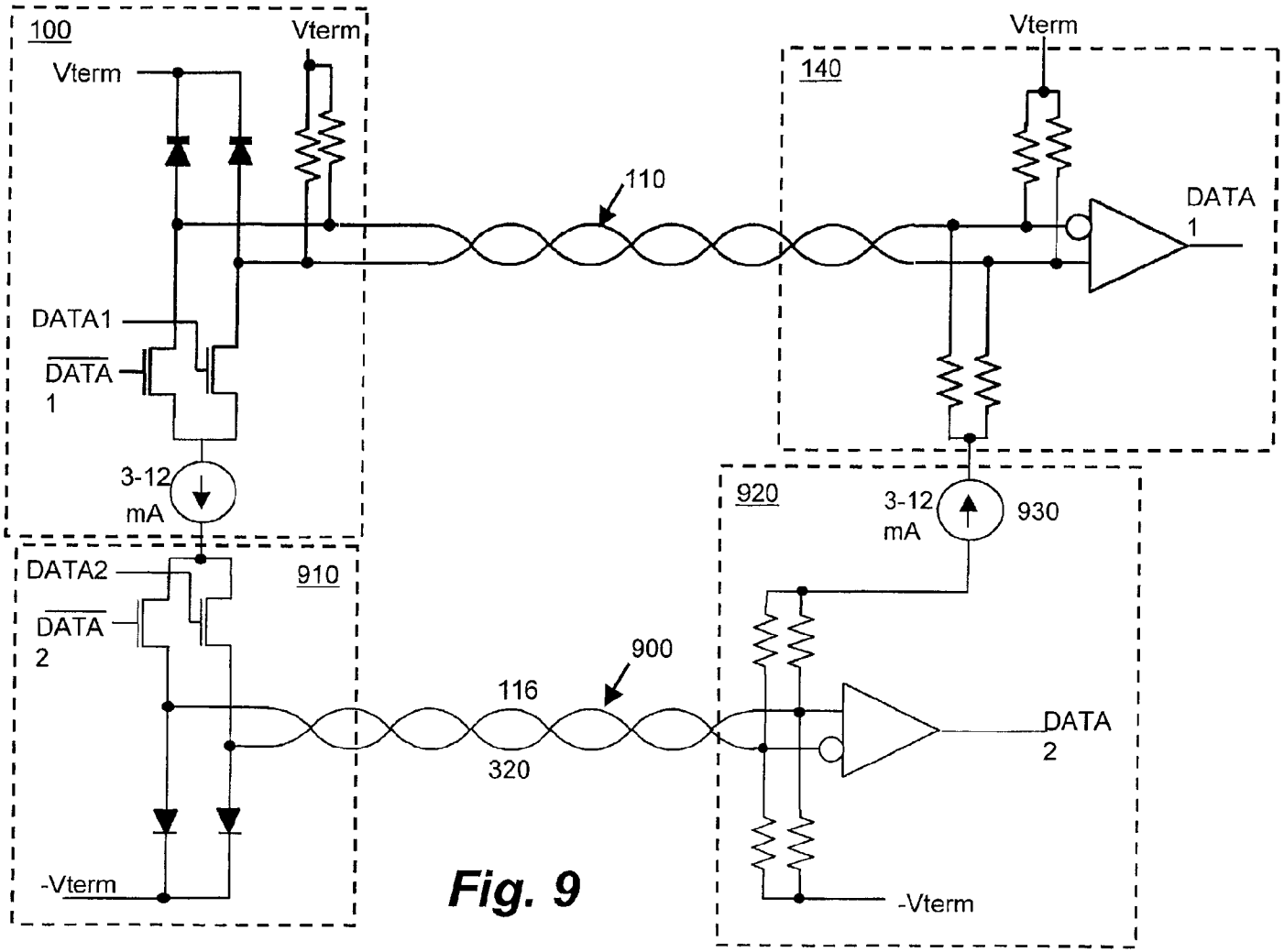
FIG. 9 displays an enhanced TMDS system having increased data capacity.

Turning now to FIG. 9, it may be seen that another embodiment of the present invention may employ the current return path 116 in conjunction with a second data line 320 to increase the data capacity of a unidirectional data transmission. By adding a single data line 320, an additional "outbound" data pair 900 may be formed. The data pair 900 forms a complementary output to the three data pairs 110, 120, 130 of a basic TMDS transmitter 100. (Note that FIG. 9 shows only a single data pair 110 in order to maintain clarity.) The data pair 900 may be driven by a second transmitter 910. Similarly, a second receiver 920 may accept data. The second receiver 920 may include a second current source 930 in order to balance the current and voltage across the data communications loop formed by the transmitters 100, 910 and receiver 140, 920.

Of course, a dual transmitter array may also be created by adding two additional data pairs (not shown) to the data pair 900 created from the current return path 116. This would effectively double the data transmission capacity of a standard TMDS transmitter 100, but use only four additional data lines instead of the five necessary for two standard transmitters arrayed side by side.

Note that in any of the above described embodiments, the operation of the second channel—regardless of the direction in which it is to be used—may be suspended for compatibility with current single-channel, unidirectional systems. In this mode of operation, one of the conductors of the second data pair may assume the role of the original DC return. Thus, any transmitter, receiver, or transceiver devices built to support this new system can also be used with interconnects built to the current single-channel standards.

As will be recognized by those skilled in the art from the foregoing description of example embodiments of the invention, numerous variations on the described embodiments may be made without departing from the spirit and scope of the invention. For example, a transceiver may employ more or fewer numbers of transistors and data lines, or a different type of filter may be used to minimize or eliminate line noise. Further, while the present invention has been described in the context of specific embodiments and data transmissions, such descriptions are by way of example and not limitation. Accordingly, the proper scope of the present invention is specified by the following claims.

What is claimed is:

1. A bi-directional high speed video data transmission system, comprising:

a transmitter operative to receive and transmit a first video data stream;

a data pair connected to the transmitter, operative to relay the first video data stream from the transmitter;

a receiver connected to the data pair and operative to receive the first video data stream relayed by the data pair;

a first and second summing resistor connected to the data pair, the first and second summing resistor operative to convert a current transmitted across the data pair to a DC return current;

a return transmitter connected to the first and second summing resistor and operative to receive the DC return current and a return video data stream, further operative to transmit the return video data stream;

a return data pair connected to the return transmitter, operative to relay the return serial video data stream from the transmitter; and a return receiver connected to the return data pair and operative to receive the return video serial data stream, the return receiver further connected to the transmitter; wherein:

the data pair comprises a first and second data line;

the return data pair comprises a first and second return data line;

the transmitter transmits the first video data stream by switching a DC-balanced current between the first and second data line, thus creating a first and second AC current on the first and second data line;

the first and second summing resistor convert the current transmitted across the data pair to a DC return current by merging the first AC current with the second AC current; and the return transmitter transmits the return video data stream by switching the DC return current between the first and second return data line, thus creating a first and second AC return current on the first and second return data line.

2. The bi-directional high speed video data transmission system of claim 1, further comprising a filter connected between the first and second summing resistor and the return transmitter.

3. The bi-directional high speed video data transmission system of claim 2, wherein the filter eliminates line noise present in the DC return current.

4. The bi-directional high speed video data transmission system of claim 2, wherein the filter is an LC filter.

5. The bi-directional high speed video data transmission system of claim 1, further comprising:

a first clock signal having a regularly repeating digital clock pulse;

the transmitter operative to regulate the switching of the DC-balanced current between the first and second data line according to the digital state of the clock pulse; and the return transmitter operative to regulate the switching of the DC return current between the first and second return data line according to the digital state of the clock pulse.

6. The bi-directional high speed video data transmission system of claim 5, wherein:

the transmitter regulates the switching of the DC-balanced current between the first and second data line by switching the DC-balanced current at a time corresponding to a first edge of the clock pulse; and the return transmitter regulates the switching of the DC return current between the first and second data line by switching the DC return current at a time corresponding to a second edge of the clock pulse.

7. The bi-directional high speed video data transmission system of claim 1, further comprising:

a first clock signal having a first period;

the transmitter further operative to regulate the switching of the DC-balanced current between the first and second data line according to the digital state of the first clock pulse;

a second clock signal having a second period of different duration than the first period;

the return transmitter further operative to regulate the switching of the DC return current between the first and second return data line according to the digital state of the clock pulse.

8. A video camera incorporating the bi-directional high speed video data transmission system of claim 1.

9. A computer video system incorporating the bi-directional high speed video data transmission system of claim 1.

10. The bi-directional high speed video data transmission system of claim 1, further comprising a first and second return summing resistor connected between the return data pair and the transmitter, the first and second return summing resistor operative to merge the AC current transmitted across the first return data line with the AC current transmitted across the second data line into a DC current.

11. The bi-directional high speed video data transmission system of claim 10, wherein:

the transmitter, return receiver, and first and second return summing resistor comprise a first transceiver;

the return transmitter, receiver, and first and second summing resistor comprise a second transceiver; and the circuitry of the first and second transceivers are identical.

12. A unidirectional high speed video data transmission system, comprising:

a first transition minimized differential signaling transmitter operative to transmit a first video data stream by alternating a DC current between a first and second data line;

a data pair comprised of the first and second data line and having a first and second end, the data pair connected to the first transition-minimized differential signaling transmitter at the first end, the data pair further connected to a first transition-minimized differential signaling receiver at the second end, the data pair operative to relay the first video data stream from the first transmitter to the first receiver;

the first transition-minimized differential signaling receiver operative to receive and output the first video data stream;

a first summing resistor connected to the first data line;

a second summing resistor connected to the second data line;

the first and second summing resistors comprising a first summing pair operative to merge the alternating current across the first and second data lines to form a DC return current;

a second transition minimized differential signaling transmitter operative to transmit a second video data stream by alternating a second DC current between a third and fourth data line;

a second data pair comprised of the third and fourth data line and having a first and second end, the second data pair connected to the second transition-minimized differential signaling transmitter at the first end, the second data pair further connected to a second transition-minimized differential signaling receiver at the second end, the second data pair operative to relay the second video data stream from the second transmitter to the second receiver;

the second transition-minimized differential signaling receiver operative to receive and output the second video data stream;

a third summing resistor connected to the third data line;

a fourth summing resistor connected to the fourth data line;

the third and fourth summing resistors comprising a second summing pair operative to merge the alternating current across the third and fourth data lines to form a DC final current;

wherein the DC return current and the second DC current are the same; and wherein the third data line functions as a DC return channel.

13. The unidirectional high speed video data transmission system of claim 12, further comprising:

a clock signal having a regularly repeating digital clock pulse;

the first transition-minimized differential signaling transmitter operative to regulate the switching of the DC current between the first and second data line according to the digital state of the clock pulse; and the second transition-minimized differential signaling transmitter operative to regulate the switching of the DC return current between the first and second return data line according to the digital state of the clock pulse.

14. The unidirectional high speed video data transmission system of claim 13, wherein:

the first transition-minimized differential signaling transmitter regulates the switching of the DC current between the first and second data line by switching the DC current at a time corresponding to a first edge of the clock pulse; and the second transition-minimized differential signaling transmitter regulates the switching of the DC return current between the first and second data line by switching the DC return current at a time corresponding to a second edge of the clock pulse.

15. The unidirectional high speed video data transmission system of claim 14, further comprising a filter located between the first and second summing pairs, the filter operative to minimize line noise in the video data transmission system.

16. A method for enabling bi-directional high speed video data transmission, comprising the steps of:

receiving a parallel video data signal;

receiving a DC input current;

encoding the parallel video data signal as a serial video data signal;

transmitting the serial video data signal across a first and second data line by alternately transferring the DC input current between a first data line and a second data line to yield a first and second AC current, the first and second currents alternating between zero and a fixed value, the first and second currents one hundred eighty degrees out of phase with one another;

receiving the serial video data signal;

decoding the serial video data signal into the parallel video data signal;

summing the first and second currents into a DC return current;

receiving a return parallel video data signal;

encoding the return parallel video data signal as a return serial video data signal;

transmitting the return serial video data signal across a first and second return data line by alternating the DC return current across the first and second return data lines to yield a first and second return AC current, the first and second return AC currents alternating between zero and a fixed value, the first and second return AC currents one hundred eighty degrees out of phase with one another;

receiving the return serial video data signal; and decoding the return serial video data signal into the return parallel video data signal.

17. The method of claim 16, further comprising the step of, in response to summing the first and second currents into a DC return current, filtering line noise from the DC return current.

18. The method of claim 16, further comprising the steps of:

summing the first and second return currents into a DC loop current; and using the DC loop current as the DC input current.

19. The method of claim 16, further comprising the steps of:

receiving a clock signal having a rising edge and falling edge;

in response to receiving the rising edge of the clock signal, alternating the DC input current across the first and second data lines; and in response to receiving the falling edge of the clock signal, alternating the DC return current across the first and second return data lines.

* * * * *